US006497105B1

(12) United States Patent
Stastny

(10) Patent No.: US 6,497,105 B1
(45) Date of Patent: Dec. 24, 2002

(54) LOW COST COMBUSTOR BURNER COLLAR

(75) Inventor: Jan Honza Stastny, Georgetown (CA)

(73) Assignee: Pratt & Whitney Canada Corp., Longueuil (CA)

( * ) Notice: Subject to any disclaimer, the term of this patent is extended or adjusted under 35 U.S.C. 154(b) by 0 days.

(21) Appl. No.: 09/871,892

(22) Filed: Jun. 4, 2001

(51) Int. Cl.[7] ..... F02C 7/20

(52) U.S. Cl. ..... 60/796; 60/799; 60/740; 29/890.01

(58) Field of Search ..... 60/796, 799, 740, 60/752; 29/890.01

(56) References Cited

U.S. PATENT DOCUMENTS

| | | | |
|---|---|---|---|
| 3,939,653 | A | 2/1976 | Schirmer |
| 4,322,945 | A | 4/1982 | Peterson et al. |
| 4,748,806 | A | 6/1988 | Drobny |
| 4,999,996 | A | 3/1991 | Duchene et al. |
| 5,222,358 | A | 6/1993 | Chaput et al. |
| 5,253,471 | A | 10/1993 | Richardson |
| 5,265,409 | A | 11/1993 | Smith, Jr. et al. |
| 5,271,219 | A | 12/1993 | Richardson |
| 5,323,601 | A | 6/1994 | Jarrell et al. |
| 5,435,139 | A | 7/1995 | Pidcock et al. |
| 5,501,071 | A | 3/1996 | Ansart et al. |
| 5,509,270 | A | 4/1996 | Pearce et al. |
| 5,758,503 | A | 6/1998 | DuBell et al. |
| 5,894,732 | A | 4/1999 | Kwan |
| 5,924,288 | A | 7/1999 | Fortuna et al. |
| 5,974,805 | A | 11/1999 | Allen |
| 5,996,335 | A | 12/1999 | Ebel |

*Primary Examiner*—Ehud Gartenberg
(74) *Attorney, Agent, or Firm*—Wayne H. Van; Ogilvy Renault

(57) ABSTRACT

A head part of an annular combustor for a gas turbine includes an annular bulkhead at the upstream end of the combustor. The bulkhead includes a first annular section integrally, inwardly and radially extending from the outer annular wall of the combustor, and a second annular section integrally, outwardly and radially extending from the annular inner wall of the combustor. The first and second annular sections are overlapped adjacent to the annular inner wall and secured together by segmented heat shields which have integrated threaded studs engaging with self-locking nuts, and cover the downstream side of bulkhead. The first annular section has a plurality of apertures circumferentially spaced apart from one another to receive fuel burners. Each burner is radial-displaceably positioned in the aperture and sealed by a burner collar, which is clamped between the heat shield and the bulkhead wall. This provides a simple configuration of a head part of combustor in which heat shields are used to interconnect sections of bulkhead and secure the burner collar to the bulkhead.

17 Claims, 3 Drawing Sheets

LOW COST COMBUSTOR BURNER COLLAR

FIELD OF THE INVENTION

The present invention relates to a gas turbine engine combustor and more particularly to a head part of an annular gas turbine combustor having low cost fuel burner collars to accommodate fuel burners radial-displaceably positioned in passage openings in an upstream end wall of the annular combustor.

BACKGROUND OF THE INVENTION

Modern gas turbine engines are commonly provided with a generally annular combustor. Usually a wall or bulkhead is provided at the upstream end of the combustor which is suitably apertured to receive a number of fuel burners. The fuel burners are equally spaced around the combustor and direct fuel into the combustor to support combustion therein. The combustor upstream end wall is therefore usually positioned close to the high temperature combustion process taking place within the combustor, making it vulnerable to heat damage.

One way of protecting the upstream end wall of the combustor from the direct effects of the combustion process is to position heat shields on its vulnerable parts. Typically, each heat shield is associated with a corresponding fuel burner and extends both radially towards the radially inner and outer extents of the upstream end wall and circumferentially to abut adjacent heat shields. Each heat shield is spaced apart from the upstream end wall so that a narrow space is defined between them. Cooling air is directed into these spaces in order to provide cooling of the heat shields and so maintain the heat shields and the upstream end wall at acceptably low temperatures.

In practice a fuel burner collar assembly is used to sealingly accommodate the fuel burner radial-displaceably positioned within the passage openings of the upstream end wall of the combustor to permit thermo expansion and contraction of the fuel burner with respect to the upstream end wall of the combustor. Thus, the pressurized air outside the combustor is inhibited from uncontrolled entry into the combustor through the annulus between the fuel burner and the upstream end wall of the combustor.

Conventional fuel burner collar assemblies in the prior art generally have attachment means including for example, brazing, locking sleeves and various interlocking tabs on the collars. One example of fuel collar assemblies is described in U.S. Pat. No. 5,253,471 and 5,271,279, both issued to Richardson on Oct. 19, 1993 and Dec. 21, 1993 respectively. Richardson describes in his both patents, a gas turbine engine annular combustor having a bulkhead at its upstream end which is protected by an annular array of heat shields. An annular seal is located in each bulkhead aperture to receive the fuel burner outlet end, and is provided with a flange which is interposed between an L-shaped cross-section ring and a further ring. The L-shaped ring and the further ring are interconnected by means to support the annular seal, preventing axial movement thereof, but permitting a limited degree of radial movement.

Another example of fuel burner collar assemblies is described in U.S. Pat. No. 5,894,732, issued to Kwan on Apr. 20, 1999. A radially extending flange of the burner sealing part is clamped between the heat shield and the end wall of the combustor. At least one or more annular elements are provided in combination with the burner sealing part and the heat shield to form a relatively complex interlocking system with a series of air supply apertures and chambers to cool the adjacent areas.

A further example of fuel burner assemblies is described in U.S. Pat. No. 5,974,805, issued to Allen on Nov. 2, 1999. Allen describes an arrangement in which a burner miniflare seal is held in position by the heat shield. The heat shield has an aperture, the periphery of which is defined by an axial flange and the burner miniflare seal includes a cylinder portion and a pair of radially extending flanges which slidably engage with the heat shield flange extremities. As a result, the heat shield serves to radially slidably retain the burner miniflare seal. However, an axial flange must be integrated with each heat shield segment which receives the fuel burner, in contrast to conventional heat shields. Furthermore, Allen fails to teach how to place the burner miniflare seal in position within the axial flange of the heat shield if both radial flanges of the seal have a diameter large enough to slidably engage with the heat shield flange extremities, especially when the seal with the pair of radial flanges is an integral single piece part. It would be apparent to those skilled in the art that a multiple piece configuration should be used for the burner miniflare seal in order to position same within the axial flange of the heat shield.

Therefore, there is a need for a simple, one-piece configuration of burner collar without additional securing parts, which will reduce the manufacturing cost thereof.

SUMMARY OF THE INVENTION

One object of the present invention is to provide a low cost combustor burner collar assembly which positions a fuel burner in a passage opening in an upstream end wall of a combustor and permits the thermal expansion and contraction thereof with respect to the upstream end wall of the combustor.

Another object of the present invention is to provide a head part of a gas engine combustor wherein a single piece fuel burner collar is radial-displaceably secured to the combustor only by a heat shield attached to the combustor wall.

In accordance with one aspect of the present invention, there is provided a head part of an annular combustor for a gas turbine engine having an upstream end wall with passage openings each of which accommodates a fuel burner. The head part comprises a heat shield detachably secured to a downstream side of the upstream end wall and covering an inner surface thereof, and a burner collar positioned within each of the passage openings and accommodating a corresponding one of the fuel burners. The burner collar has a radial flange with opposed first and second annular radial surfaces. The burner collar is axially restrained directly by the upstream end wall and the heat shield in a manner wherein a radial surface of the downstream side of the upstream end wall abuts the first annular radial surface of the flange, and a radial surface of an upstream side of the heat shield abuts the second annular radial surface of the flange, such that the burner collar is radially displaceable with respect to the upstream end wall.

The burner collar preferably includes an annular cylinder, and the radial flange extends radially and outwardly from the external periphery of the annular cylinder.

In one embodiment of the present invention the burner collar includes an annular cylinder and a skirt portion having an outer diameter smaller than a diameter of the passage opening in the upstream end wall of the combustor. The flange preferably extends radially and outwardly from a downstream end of the annular cylinder and has an outer diameter greater than the diameter of the passage opening. The heat shield preferably has threaded studs which are integrated with the heat shield and extend through openings in the upstream end wall of the combustor. Self-locking nuts are used to engage the respective threaded studs in order to secure the heat shield to the upstream end wall. The heat shield has a configuration such that when the heat shield is secured to the upstream end wall the radial surface of the heat shield is axially spaced a predetermined distance apart from the radial surface of the downstream side of the upstream end wall to form a gap for fittably and radial-displaceably accommodating the flange of the burner collar therein.

In accordance with another aspect of the present invention, there is provided a method for securing a burner collar to a gas turbine engine combustor for accommodating a fuel burner radial-displaceably positioned in a passage opening in an upstream end wall of the combustor. The method comprises a step of axially restraining the burner collar in the passage opening by using a heat shield which is detachably secured to a downstream side of the upstream end wall and covering an inner surface thereof, to directly abut a radial flange of the burner collar against a radial surface of the upstream end wall of the combustor such that the burner collar is radially displaceable with respect to the upstream end wall of the combustor.

In contrast to multi-part assemblies of burner collars in the prior art, the present invention advantageously provides a single piece configuration of a burner collar which needs no additional parts to hold the burner collar in position. Instead, the axial flange of the burner collar is simply clamped between the conventional heat shield and the upstream end wall of the combustor. Therefore, the burner collar can be manufactured economically and the overall weight of the gas turbine engine combustor can be reduced, which is also a desirable advantage especially when the gas turbine engine is used in aircraft.

Other advantages and features of the present invention will be better understood with reference to a preferred embodiment of the present invention described hereinafter.

BRIEF DESCRIPTION OF THE DRAWINGS

Having thus generally described the nature of the invention, reference will now be made to the accompanying drawings, showing a preferred embodiment by way of illustration, in which.

DETAILED DESCRIPTION OF THE PREFERRED EMBODIMENT

Figure 1:
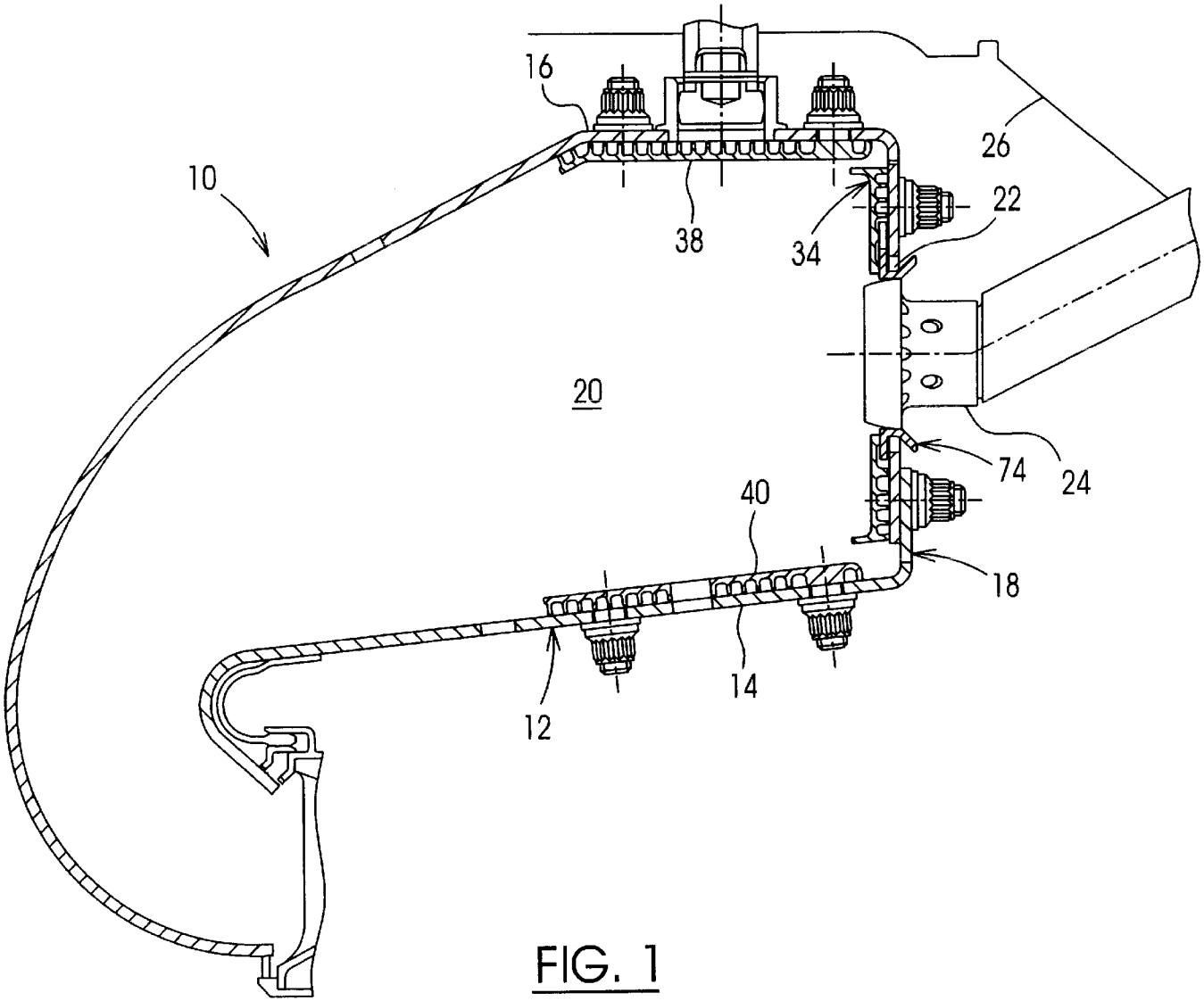
FIG. 1 is a partial cross-sectional view of a gas turbine engine, showing an annular combustor incorporating an embodiment of the present invention.

Referring to the drawings, particularly to FIG. 1, an annular combustor 10 is shown. The inner casing 12 of the annular combustor 10 includes radially spaced annular inner and outer walls 14 and 16 respectively, interconnected at their upstream ends by means of an annular upstream end wall, usually called a bulkhead 18, to form an annular combustor chamber 20.

A plurality of passage openings 22 (only one shown) are provided in the bulkhead 18, each one receiving the outlet end of a fuel burner 24 which is suspended from an outer casing structure 26 for delivery of fuel and air into the combustion chamber 20. The passage openings 22 are equally spaced around the bulkhead 18.

Figure 2:
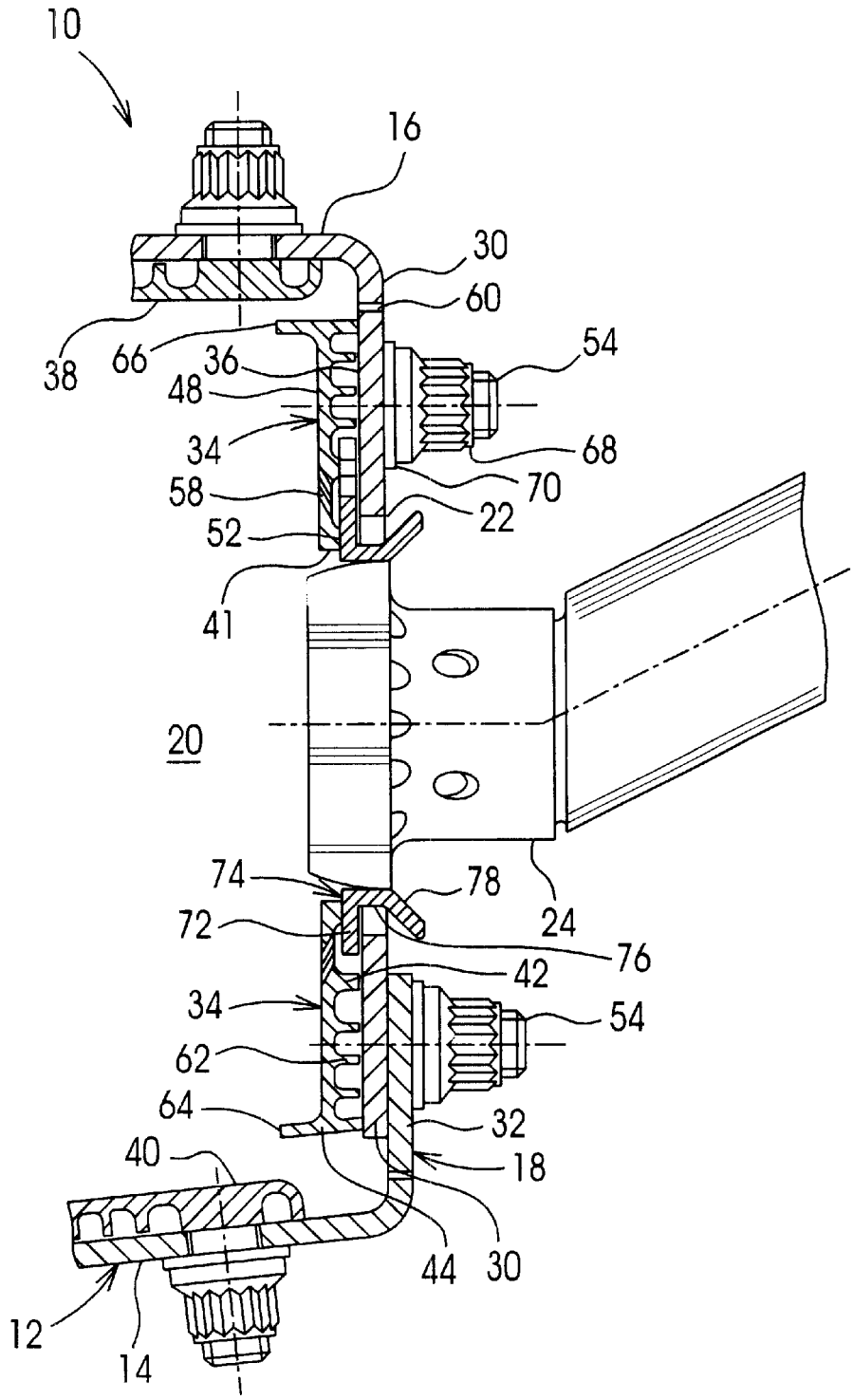
FIG. 2 is a partial cross-sectional view of an annular combustor in an enlarged scale, illustrating details of the embodiment shown in FIG. 1.

As more clearly shown in FIG. 2, the bulkhead 18 has a first annular section 30 which integrally extends radially and inwardly from the annular outer wall 16 of the combustor 10, and a second annular section 32 which integrally extends radially and outwardly from the annular inner wall 14 of the combustor 10. The first and second sections 30, 32 are overlapped in part, adjacent to the annular inner wall 14, and are secured together by locking means which are described with details hereinafter. The plurality of passage openings 22 are located in the first annular section 30 of the bulkhead 18.

The bulkhead 18 is particularly vulnerable to over heating as a result of the combustion process which takes place within the combustor chamber 20. In order to provide thermal shielding of the bulkhead 18, segmented heat shields 34 are attached to the downstream side of the first annular section 30 of the bulkhead 18, covering an inner surface 36 thereof. Heat shields 38, 40 are also provided to cover the inner surfaces of the respective annular inner and outer walls 14, 16 at an area adjacent to the bulkhead 18.

Figure 3:
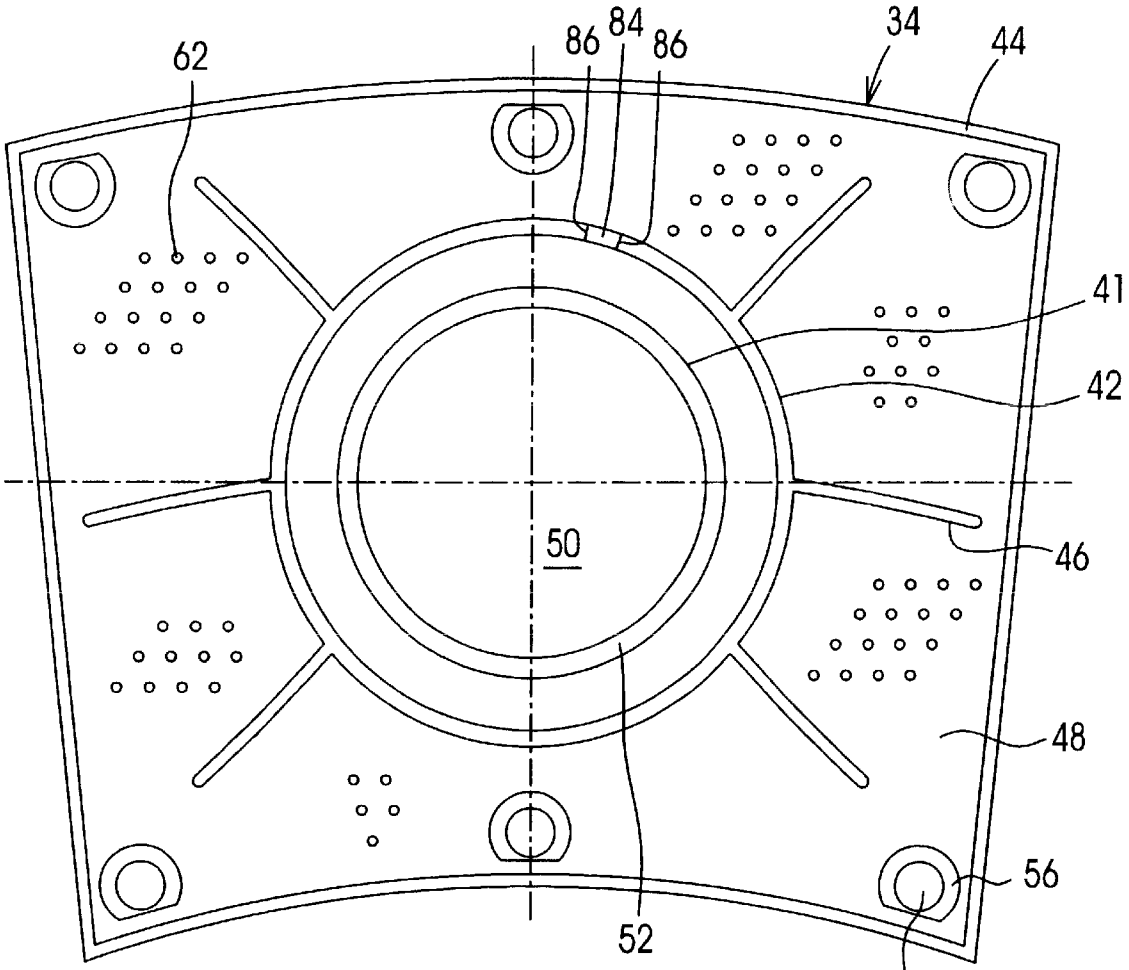
FIG. 3 is a front view of a heat shield used in the embodiment in FIG. 1, showing the upstream side thereof.

As more clearly shown in FIG. 3, each heat shield 34 is of generally truncated sectorial configuration, having ridges 41, 42, 44 and 46 projecting from the shield plate 48. The shield plate 48 has a circular opening 50 having a diameter smaller than the passage openings 22 of the bulkhead 18 and greater than the periphery of the outlet end of the fuel burner 24 (see FIG. 2). The ridge 41 is circular and defines the periphery of the opening 50, and includes a radial surface 52. The ridge 42 is also circular, radially spaced apart from the ridge 41, and as more clearly shown in FIG. 2, the ridge 42 has a thickness greater than the thickness of ridge 41. Ridges 44, 46 have the same thickness as that of ridge 42 so that the ridges 42, 44 and 46 provide an equal spacing between the shield plate 48 and the inner surface 36 of the first section 30 of the bulkhead 18 when the heat shield 34 is secured to the bulkhead 18.

As illustrated in FIG. 2, the heat shield 34 includes a plurality of threaded studs 54 extending from a thickened portion 56 (see FIG. 3) of the shield plate 48. The thickened portion 56 has a thickness equal to or slightly less than the thickness of the ridges 42, 44 and 46 to maintain the equal and even spacing. Small holes 58 and 60 in the respective shield 34 and the bulkhead 18 form cooling air passages to direct pressurized cool air from outside of the combustor chamber 20, through the space between the heat shield 34 and the bulkhead 18, entering the combustor chamber 20 to cool the bulkhead 18 and the heat shield 34. A plurality of pins 62 integrally project from the shield plate 48 to increase air contacting surfaces of the heat shield 34 for a better cooling result. The heat shield 34 further includes inner and outer ridges 64, 66 extending outwardly from the shield plate 48 towards the inside of the combustor chamber 20 to form air channels adjacent to the heat shields 38, 40 for a better cooling result.

When the heat shield 34 is mounted to the bulkhead 18, the threaded studs 54 positioned close to the annular outer wall 16 extend through mounting holes in the first annular section 30 and engage with self-locking nuts 68 and washers 70 to secure the heat shield 34 to the downstream side of the bulkhead 18. The threaded studs 54 positioned close to the annular inner wall 14 extend through mounting holes in the first and second annular sections 30, 32 to engage with self-locking nuts 68 washers 70 to not only secure the heat shield 34 to the downstream side of the bulkhead 18, but also to securely join together the overlapped portions of the first and second annular sections 30, 32 to form the assembled bulkhead 18.

The annular radial surface 52 of the annular ridge 41 is spaced apart from the inner surface 36 of the first annular section 30 of the bulkhead 18 because the thickness of the ridge 41 is less than the thickness of the spacing ridges 42, 44 and 46, forming a gap between the radial surface 52 of the heat shield 34 and the inner surface 36 of the bulkhead 18, to fittably accommodate a radial flange 72 of a burner collar 74.

The burner collar 74 includes an annular cylinder 76. The annular radial flange 72 extends radially and outwardly from a downstream end of the annular cylinder 76 and has an outer diameter greater than the passage opening 22 of the bulkhead 18. A skirt portion 78 extends radially, axially and outwardly from an upstream end of the annular cylinder 76 and has an outer diameter smaller than a diameter of the passage opening 22 of the bulkhead 18. Thus the burner collar 74 is positioned within the passage opening 22 of the bulkhead 18 to accommodate the fuel burner 24, the inner surface of the annular cylinder 76 sealingly contacting the outer periphery of the burner 24 to inhibit pressurized air outside the combustor chamber 20 from uncontrollable admission into the combustor chamber 20.

The distance between the annular radial surface 52 of the heat shield 34 and the inner surface 36 of the bulkhead 18 can be predetermined to a high degree of accuracy during the machining process. Thus, the radial inner surface 36 of the bulkhead 18 closely abuts the radial surface of the annular flange 72 at the upstream side thereof and the radial surface 52 of the heat shield 34 closely abuts the radial surface of the annular flange 32 at the downstream side thereof. Such a configuration axially restrains the position of the burner collar 74 with respect to the bulkhead 18 and minimizes air leakage between the burner collar 74 and the respective heat shield 34 and the bulkhead 18, while permitting radial displacement of the burner collar 74 with respect to the bulkhead 18 and the heat shield 34.

Figure 4:
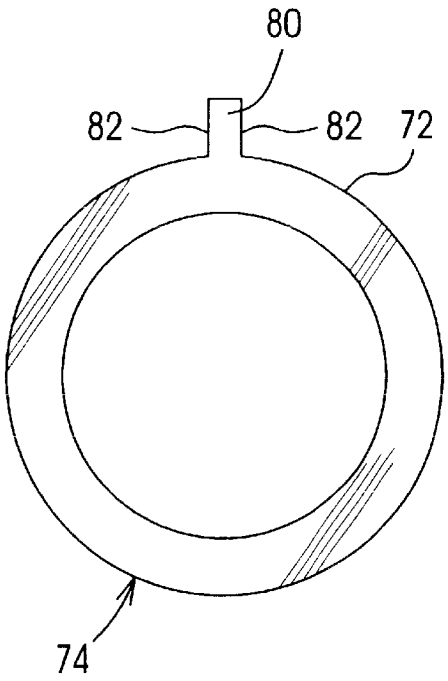
FIG. 4 is a rear view of a burner collar used in the embodiment of FIG. 1, showing the downstream side thereof.

As more clearly shown in FIGS. 3 and 4, the radial, flange 72 of the burner collar 74 further includes a tab 80 projecting radially and outwardly with a pair of side surfaces 82. The tab 80 fits into an axial recess 84 in ridge 42 with a pair of side walls 86. Thus, the interfaces 82 and 86 between the tab 80 and the recess 86 inhibit rotational movement of the burner collar 74 with respect to the bulkhead 18.

In a disassembly process, the self-locking nuts 68 and washers 70 positioned close to the annular inner wall 14 are disengaged from the threaded studs 54 to permit removal of the annular inner wall 14 of the combustor 10. The self-locking nuts 68 and washers 70 positioned close to the annular outer wall 16 of the combustor 10 are then disengaged from the studs 54 permitting detachment of the heat shield 34 from the downstream side of the first annular section 16 of the bulkhead 18. Finally, the burner collar 74 can be withdrawn from the passage opening 22 of the bulkhead 18 towards the inside of the combustor chamber 20. The process is reversed in the assembly process thereof.

Modifications and improvements to the above described embodiment of the present invention may become apparent to those skilled in the art. The forgoing description is intended to be exemplary rather than limiting. The scope of the invention is therefore intended to be limited solely by the scope of the appended claims.

I claim:

1. A head part of an annular combustor for a gas turbine engine, comprising:

an annular upstream end wall with a plurality of passage openings circumferentially spaced apart from one another, each passage opening accommodating a fuel burner, a heat shield detachably secured to a downstream side of the upstream end wall and covering an inner surface thereof;

a burner collar positioned within each of the passage openings and accommodating a corresponding one of the fuel burner, the burner collar having a radial flange with opposed first and second annular radial surfaces; and the burner collar being axially restrained directly by the upstream end wall and the heat shield in a manner wherein a radial surface of the downstream side of the upstream end wall abuts the first annular radial surface of the flange, and a radial surface of an upstream side of the heat shield abuts the second annular radial surface of the flange such that the burner collar is radially displaceable with respect to the upstream end wall.

2. The head part as claimed in claim 1 wherein the; upstream end wall comprises a first annular section integrally extending radially and inwardly from an outer wall of the combustor, and a second annular section integrally extending radially and inwardly from an inner wall of the combustor, the first and second sections being overlapped in part and secured together by locking means which secure the heat shield to the upstream end wall.

3. The head part as claimed in claim 2 wherein the first annular section comprises the passage openings, the first and second sections being joined adjacent to the inner wall.

4. The head part as claimed in claim 3 wherein the heat shield is segmented, each segment including a shield plate and a plurality of threaded studs extending perpendicularly from the shield plate to engage with self-locking nuts to secure the heat shield, the first section and second section of the upstream end wall together.

5. The head part as claimed in claim 1 wherein the burner collar comprises an annular cylinder, the radial flange extending radially and outwardly from an external periphery of the annular cylinder.

6. The head part as claimed in claim 1 wherein the burner collar comprises an annular cylinder and a skirt portion extending radially, axially and outwardly from an upstream end of the annular cylinder, the skirt portion having an outer diameter smaller than a diameter of the passage opening.

7. The head part as claimed in claim 6 wherein the flange extends radially and outwardly from a downstream end of the annular cylinder and has an outer diameter greater than the diameter of the passage opening.

8. The head part as claimed in claim 1 wherein the radial surface of the heat shield is axially spaced a predetermined distance apart from the radial surface of the downstream side of the upstream end wall when the heat shield is secured to the upstream end wall, in order to form a gap for fittably and radial-displaceably accommodating the flange of the burner collar therein.

9. The head part as claimed in claim 8 wherein the heat shield comprises means for positioning the heat shield with respect to the upstream end wall of the combustor.

10. The head part as claimed in claim 9 wherein the heat shield comprises means for locking the heat shield onto the upstream end wall of the combustor.

11. The head part as claimed in claim 8 wherein the heat shield comprises a plurality of ridges projecting from the upstream side, the ridges determining the predetermined distance between the radial surface of the shield and the radial surface of the upstream end wall.

12. The head part as claimed in claim 1 wherein the heat shield comprises an aperture for accommodating the burner, the radial surface being annular and surrounding the aperture.

13. The head part as claimed in claim 12 wherein the aperture of the heat shield has a diameter smaller than an outer diameter of the flange of the burner collar, and greater than an inner diameter of the burner collar.

14. A method of securing a burner collar to a gas turbine engine combustor for accommodating a fuel burner radial-displaceably positioned in a passage opening in an upstream end wall of the combustor, comprising a step of axially restraining the burner collar in the passage opening by using a heat shield which is detachably secured to a downstream side of the upstream end wall and covering an inner surface thereof, to directly abut a radial flange of the burner collar against a radial surface of the upstream end wall of the combustor such that the burner collar is radially displaceable with respect to the upstream end wall of the combustor.

15. A method as claimed in claim 14 comprising a step of using nuts to engage respective threaded studs which are integrated with the heat shield and extend through openings in the upstream end wall of the combustor, in order to secure the heat shield to the upstream end wall.

16. A method as claimed in claim 15 wherein the nuts comprise self-locking means to lock the threading engagement between the nuts and the threaded studs.

17. A method as claimed in claim 14 wherein the combustor comprises an annular configuration and wherein means are used to secure first and second annular sections of the upstream end wall together with the heat shield.

* * * * *